US006300748B1

(12) United States Patent
Miller

(10) Patent No.: US 6,300,748 B1
(45) Date of Patent: Oct. 9, 2001

(54) TRANSFORMERLESS POWER SUPPLY CIRCUIT WITH A SWITCHABLE CAPACITIVE ELEMENT

(75) Inventor: Richard D. Miller, Lancaster, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 09/615,876

(22) Filed: Jul. 13, 2000

(51) Int. Cl.[7] ..... G05F 1/40
(52) U.S. Cl. ..... 323/266; 323/285; 363/126
(58) Field of Search ..... 323/266, 268, 323/284, 285, 271; 363/52, 126

(56) References Cited

U.S. PATENT DOCUMENTS 3,373,344 * 3/1968 Seer, Jr. ..... 323/266
4,060,758 11/1977 Wright .
4,480,201 10/1984 Jaeschke .
4,626,982 * 12/1986 Huber ..... 363/80
4,893,228 * 1/1990 Orrick et al. ..... 363/89
5,132,893 * 7/1992 Klein et al. ..... 363/49

* cited by examiner

*Primary Examiner*—Shawn Riley
(74) *Attorney, Agent, or Firm*—Synnestvedt & Lechner LLP

(57) ABSTRACT

A power supply circuit for providing a DC output signal from an AC input signal by (1) coupling an AC source to the DC output terminal and to a capacitor when the AC input signal is within a preselected AC voltage range thereby providing power to the DC output terminal while charging the capacitor, and (2) uncoupling the AC source from the DC output terminal and the capacitor when the AC input signal is outside of the preselected voltage range, thereby relying on the capacitor to provide power to the DC output terminal.

23 Claims, 5 Drawing Sheets

TRANSFORMERLESS POWER SUPPLY CIRCUIT WITH A SWITCHABLE CAPACITIVE ELEMENT

FIELD OF THE INVENTION

The present invention relates to a power supply circuit, and more particularly, to a DC power supply circuit which converts AC power to DC power.

BACKGROUND OF THE INVENTION

Many consumer and commercial devices require direct current (DC) power. Since alternating current (AC) power is readily available, power supply circuits which convert AC power to DC power are desirable.

A block diagram of a conventional power supply circuit 10 is depicted in FIG. 1. The power supply circuit consists of a voltage reducing device 11, rectifier 12, filter 13, and regulator 14. The voltage reducing device 11 steps the AC voltage down since DC-powered devices generally operate at a lower voltage (e.g., less than 12 volts) than commercially-supplied AC power (e.g., 120 volts). Next, the rectifier 12 converts the lower voltage level AC voltage to a pulsating DC voltage. The pulsating DC voltage is then filtered and regulated by the filter 13 and the regulator 14, respectively, to produce a relatively smooth DC voltage level.

FIG. 2 depicts a known power supply circuit 21 which embodies the functionality depicted in FIG. 1. The power supply circuit consists of a transformer 22, a full-wave bridge rectifier 23, and a capacitor 24. The transformer 22 steps down the input AC voltage to a usable level. The full-wave bridge rectifier 23, consisting of diodes D1–D4, converts the low level AC voltage into a pulsating DC voltage. The capacitor 24 filters and regulates the pulsating DC voltage to achieve a smooth DC output voltage level.

Although the conventional circuits such as the one described above have been used successfully, their design has significant shortcomings. For example, transformers tend to be heavy and bulky and thus unsuitable for miniaturized packaging. Transformers also tend to be relatively expensive given their inherent core material and windings requirements which are unlikely to be eliminated by technological advances. Aside from transformers, conventional circuits also tend to generate significant heat. Heat is generated not only by the normal operation of the circuit's components, but also by DC power generated by the circuit in excess of the load's requirements. To dissipate heat, the components are typically oversized which increases their cost and, again, poses problems in miniaturized packaging. Furthermore, as the temperature of the components rises, their operating characteristics tend to vary and their potential for failure increases.

Attempts have been undertaken to develop transformerless power supply circuits that are more efficient and compact. An example of such a circuit is depicted in FIG. 3. As shown, the circuit includes a rectifier in the form of a diode D1 and a current limiting resistor R1 at the AC input side of the power supply circuit. The circuit has a regulator in the form of a Zener diode D2 at the output side of the power supply circuit. As the AC input voltage rises, the output voltage supplied to a load increases until the output voltage exceeds the breakdown voltage of the Zener diode D2 (e.g. 5 Volts), causing the Zener diode D2 to conduct, thereby limiting the output current and voltage being supplied to the load.

In the power supply circuit of FIG. 3, excess power must be dissipated when the output voltage level is above the breakdown voltage of the Zener diode D2. The excess power is dissipated by the resistor R1, which must be physically large to dissipate the heat resulting from the large voltage drops across it. The power rating of the chosen resistor R1 will also limit the maximum AC input voltage that may be applied to the power supply circuit. For example, an input voltage of 120 Volts AC (VAC), with a Zener diode having a breakdown voltage of 5 Volts and an average current draw of 15 milliamps (ma), requires resistor R1 to have a minimum power rating of 1.73 Watts. An input voltage of 240 VAC, requires a resistor with a minimum power rating of 3.6 Watts. Thus, when the power rating of resistor R1 is chosen, the maximum level of AC input voltage is fixed.

Another known transformerless power supply circuit is disclosed in FIG. 4. As shown, the output side of the circuit contains a rectifier diode D1 leading to the load to ensure that only DC power is supplied to the load. The capacitor C1 is charged during positive portions of the AC cycle when the AC voltage is rising. During declining and negative portions of the AC cycle, the capacitor C1 supplies the power to the load.

Like the circuit of FIG. 3, however, the circuit disclosed in FIG. 4 requires physically large components to dissipate excess power due to varying levels of current being drawn by the load. For example, excess power must be dissipated when the output current at the output side of the power supply circuit exceeds the load current being drawn by the load. In the configuration shown, a large capacitor C1 and resistor R1 are required to handle the relativley large amount of power which must be dissipated. Furthermore, like the circuit of FIG. 3, the level of acceptable AC voltage is limited by the power ratings of the individual components.

Therefore, there is a need for a transformerless AC to DC power supply that is compact and efficient but avoids the need for oversized components to dissipate power. There is also a need for a power supply circuit that can accommodate different levels of AC input voltage without requiring its components to be changed out or oversized for the highest expected input power. The present invention fulfills these needs among others.

SUMMARY OF THE INVENTION

The present invention provides for a high-efficiency, transformerless power supply circuit capable of producing DC output from an AC input without the need for oversized components to dissipate excess energy. The circuit operates by coupling an AC input to a DC output terminal and to a capacitive element when the AC input is within a preselected AC voltage range, and uncoupling the AC input from the DC output terminal and capacitive element when the AC input is outside the preselected AC voltage range. Thus, the AC input supplies power to the DC output terminal while charging the capacitive element when within the preselected AC voltage range. When outside the preselected AC voltage range, the AC input is removed from the DC output terminal and power is supplied to the DC output terminal by the capacitive element. Preferably, the AC input is uncoupled from the DC output terminal for high portions of the AC input voltage.

The circuit of the present invention avoids many of the problems faced by conventional AC to DC circuits by connecting the circuit to the AC power supply for only preselected portions of the AC input signal. For example, the circuit avoids the use of a transformer and its attendant shortcomings by coupling the DC output terminal to the AC input terminal only when the AC input voltage level is within a preselected range. Therefore, there is no need to reduce the voltage. Additionally, since only selected portions of the AC input signal are used (which allows voltages to be avoided) components of the DC power supply circuit do not need to be oversized to dissipate excess power. Furthermore, the range of acceptable AC input voltages is not limited by the power ratings of the individual component because the circuit is uncoupled from the AC power supply when the voltage becomes too high. This facilitates the use of components with optimal power ratings (i.e., not overrated) which, in turn, facilitates the circuit's implementation in an integrated circuit. These advantages lead to a compact, efficient, and flexible power supply circuit.

DETAILED DESCRIPTION OF PREFERRED EMBODIMENT

Figure 1:
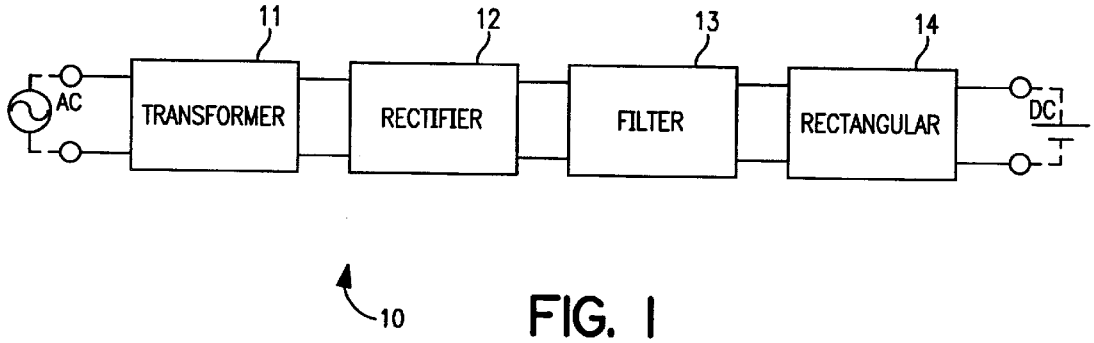
FIG. 1 PRIOR ART
FIG. 1 is a block diagram of a prior art power supply circuit.
Figure 2:
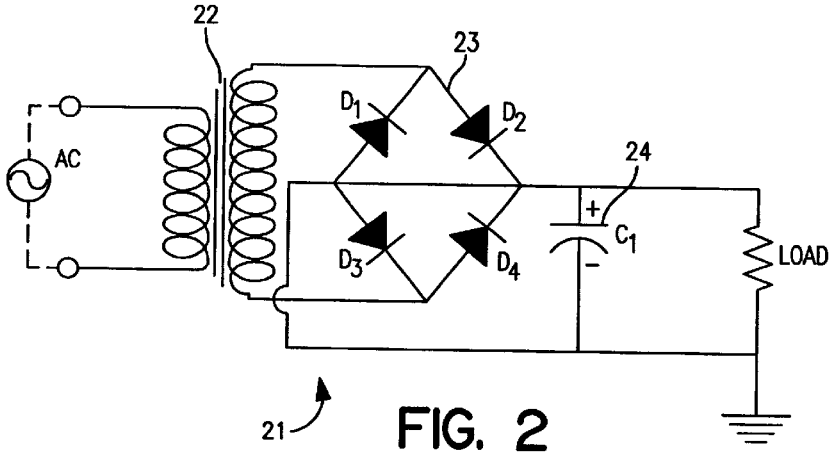
FIG. 2 PRIOR ART
FIG. 2 is a circuit diagram of a prior art power supply circuit in accordance with the block diagram of FIG. 1.
Figure 3:
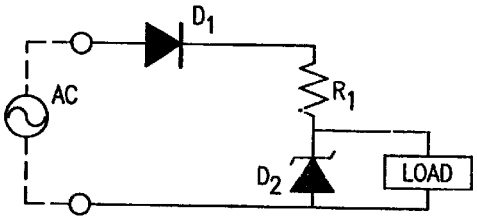
FIG. 3 PRIOR ART
FIG. 3 is a circuit diagram of a prior art transformerless power supply circuit.
Figure 4:
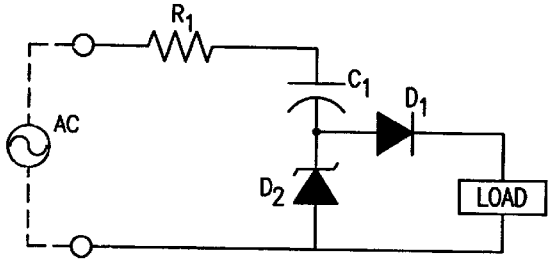
FIG. 4 PRIOR ART
FIG. 4 is a circuit diagram of a prior art transformerless power supply circuit.
Figure 5:
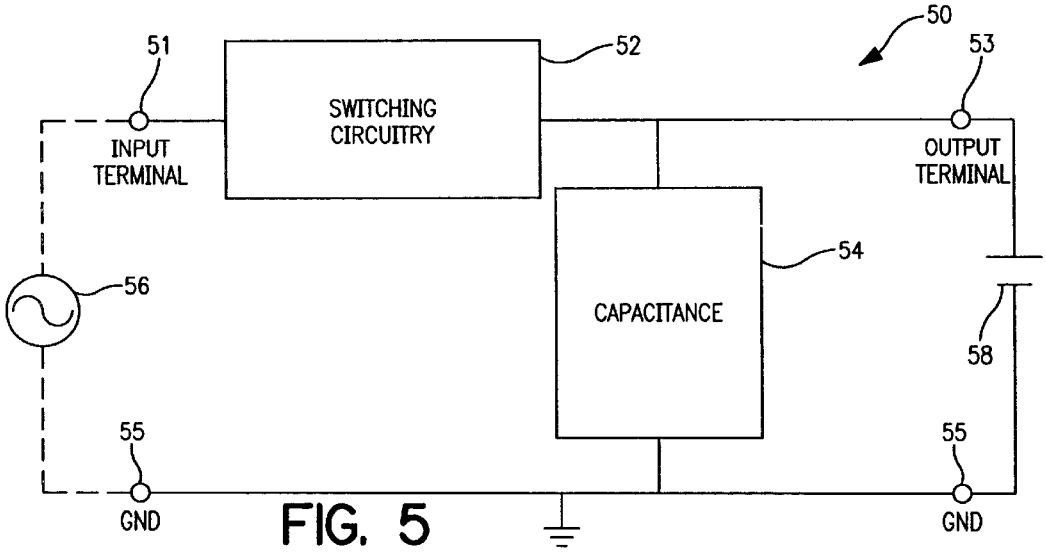
FIG. 5 is a block diagram of a power supply circuit in accordance with the present invention.

The present invention relates to a transformerless power supply circuit capable of generating a DC voltage from and an AC input voltage. As depicted in FIG. 5, a block diagram 50 of a power supply circuit in accordance with the present invention comprises switching circuitry 52 capable of coupling an AC input from an AC source 56 at input terminal 51 to an output terminal 53 where a DC output 58 is produced between the output terminal 53 and a ground terminal 55. The power circuit of the present invention comprises capacitance 54 which is coupled between the output terminal 53 and the ground terminal 55. The power circuit of the present invention supplies power to the DC output terminal 53 by (1) coupling the AC input terminal 51 to the DC output terminal 53 when the AC input at input terminal 51 is within a preselected voltage range; and (2) using a charge stored in capacitance 54 when the AC input at input terminal 51 is outside the preselected voltage range. While the AC input at input terminal 51 is within the preselected voltage range, it also charges capacitance 54. Capacitance 54 is sufficient to supply power to the DC output 58 while the AC source 56 is outside the preselected voltage range. The term "terminal," as used herein (for example, input terminal 51, output terminal 53, and ground terminal 55) may be a physical connector (for example, a pin or contact) or it may just refer to a point within a power supply circuit.

Figure 6:
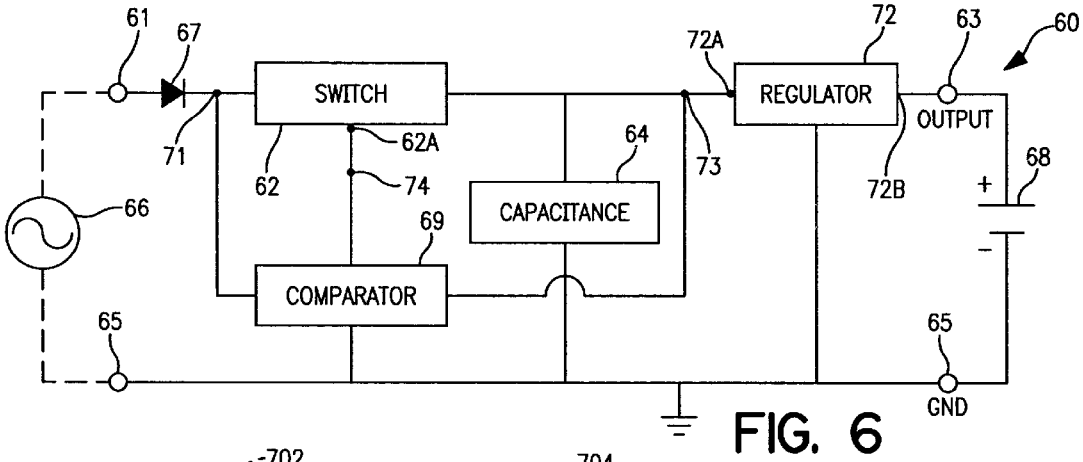
FIG. 6 is a detailed block diagram of a power supply circuit in accordance with the present invention.

FIG. 6 depicts a block diagram 60 of a power supply circuit and a preferred embodiment of the switching circuitry 52 of FIG. 5. An AC source 66 is coupled to a rectifier 67 at input terminal 61 for producing a rectified AC input at rectified input terminal 71. The coupling of the rectified AC input at rectified input terminal 71 to the output terminal 63 is regulated by switch 62 and comparator 69. Within the preselected AC voltage range of the AC input 66, switch 62 is on, coupling the rectified AC input at rectified input terminal 71 to output terminal 63. Outside of the preselected AC voltage range, switch 62 is off preventing the flow of current between input terminal 61 and output terminal 63. More specifically, switch 62 is a one directional switch, allowing current to flow only in one direction. Thus, when the voltage level at intermediate output terminal 73 is greater than the voltage level at rectified terminal 71 or control terminal 62A of switch 62, switch 62 is off. This uncouples the AC source 66 from the power supply circuit during low voltage levels.

Switch 62 is controlled by the comparator 69 coupled to the control terminal 62A of switch 62. By controlling switch 62, comparator 69 regulates the AC input for high voltage levels. Comparator 69 controls the operation of switch 62 based on voltage levels at terminals within the power supply circuit 60. The operation of comparator 69 can vary providing it controls the switch as described above. Preferably, when a voltage tap off of the voltage at intermediate terminal 73 exceeds a first predefined voltage, comparator 69 will manipulate control terminal 62A of switch 62. In a preferred embodiment, switch 62 is controlled such that the amount of current through switch 62 is regulated to avoid excess currents flowing through the power supply circuit. In addition, when a voltage tap off of the voltage at terminal 71 exceeds a second predefined voltage level, comparator 69 will turn switch 62 off. In this manner, the power supply circuit can reduce the power drawn from the AC source 66 during intermediate AC input voltages and can be uncoupled from the AC source 66 during high AC input voltage levels, thereby maximizing the amount of usable AC input voltage from AC source 66 and eliminating the need for circuit components to dissipate excess power in the power supply circuit. The configuration of the comparator 69 can vary, although generally it is preferred that it comprise at least a voltage divider for defining proportional voltages from internal power supply circuit terminals.

Regulator 72 is an optional component capable of providing a substantially constant DC voltage level if the voltage level at the regulator input 72A is maintained within a specified voltage range. The specified voltage range of the voltage regulator 72 is determined by its operation characteristics. Suitable regulators are well known in the art.

Figure 7:
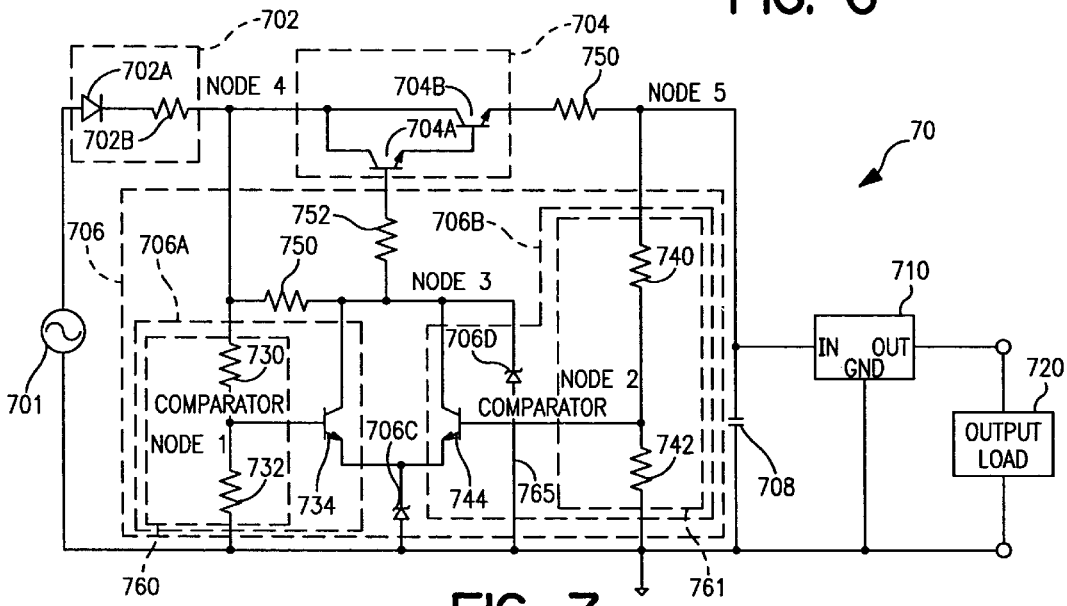
FIG. 7 is a schematic diagram of a preferred embodiment of the power supply circuit as shown in FIG. 6.

FIG. 7 depicts a circuit 70 of a preferred embodiment of the power circuit of the present invention. The circuit comprises rectifier circuit 702, switch 704, compare circuit 706, capacitor 708, and voltage regulator 710.

In the preferred embodiment, switch 704 comprises a Darlington connected transistor pair 704A and 704B to regulate a charging current to capacitor 708. The base of transistor 704A is the control terminal of switch 704. The compare circuit 706 comprises two comparators, comparator 706A comprising transistor 734 and voltage divider 760 (resistor 730 and resistor 732) and comparator 706B comprising transistor 744 and voltage divider 761 (resistor 740 and resistor 742). These comparators are used to control switch 704. Additional voltage regulation is provided by regulator 710. Depending on the degree of accuracy required for the output voltage, regulator 710 may be eliminated from the power circuit.

During the positive cycle of the AC input 701, the level will transition from zero to its peak value (e.g. 120 VAC). As the input voltage rises the voltage level of NODE 3 will also rise. When the voltage level at NODE 3 exceeds the voltage level of NODE 5 by an amount sufficient to forward bias transistor 704A and transistor 704B, transistor 704A and transistor 704B will turn on, thereby causing switch 704 to conduct. A charging current will flow from the voltage source 701 through rectifier 702, transistor 704B, and resistor 754 to capacitor 708. The charging current is a function of the current into the base of transistor 704A, related by the betas (β) of transistors 704A and 704B. The charging current will continue to flow and increase the voltage level at NODE 5. Once the voltage level at NODE 5 increases to the point that the related voltage level at NODE 2 (defined by the voltage divider 761) exceeds the breakdown voltage of Zener diode 706C plus the voltage required to forward bias transistor 744 (i.e., a predefined voltage), transistor 744 will start to conduct. The collector current through transistor 744 will produce a voltage drop across resistor 750 and cause the voltage at NODE 3 to decrease, thereby regulating switch 704 and regulating the charging current through switch 704 by regulating the base current of transistor 704A. Switch 704, voltage divider 761, and transistor 744 create a feedback path, such that the current through switch 704 will equal the current drawn by regulator 710 (or output load 720 in the absence of regulator 710). By regulating the charging current through switch 704 as the voltage level of AC source 701 increases, a larger portion of the AC input signal can be preselected without exposing the circuit to excessive voltages. Since, excessive currents are not passed, circuit components do not need to be oversized to dissipate the power and associated heat which would result from excessive currents in the power circuit.

When the input voltage level increases, the voltage level at NODE 4 will also increase. When the voltage at NODE 4 reaches a level such that the voltage level at NODE 1 (defined by the voltage divider 760) exceeds the breakdown voltage of the Zener diode 706C plus the voltage required to forward bias transistor 734 (i.e., a predefined voltage), transistor 734 will start to conduct. The collector current through transistor 734 will produce a voltage drop across resistor 750, resulting in transistor 704A and transistor 704B becoming reverse biased, thereby causing switch 704 to turn off. The switch 704 will stay off for the remainder of the rising portion of the positive AC cycle. The capacitor 708 is sized to supply the current needed by the load 720 through regulator 710 during the periods when switch 704 is off.

During the falling portion of the AC cycle the voltage at NODES 1 and 4 will decrease. When the voltage at NODE 1 drops below the breakdown voltage of Zener diode 706C plus the voltage required to forward bias transistor 734, transistor 734 will turn off and the charging current will flow again through switch 704 until the input voltage decreases to such a level that the voltage at NODE 3 goes below the voltage of NODE 5 plus the forward biasing voltages of transistors 704A and 704B, thereby turning switch 704 off. The charging current will remain off for the remaining portion of the positive AC cycle as well as the complete duration of the negative cycle. The capacitor 708 is sized to supply the current needed by the load 720 during this time period.

Figure 8:
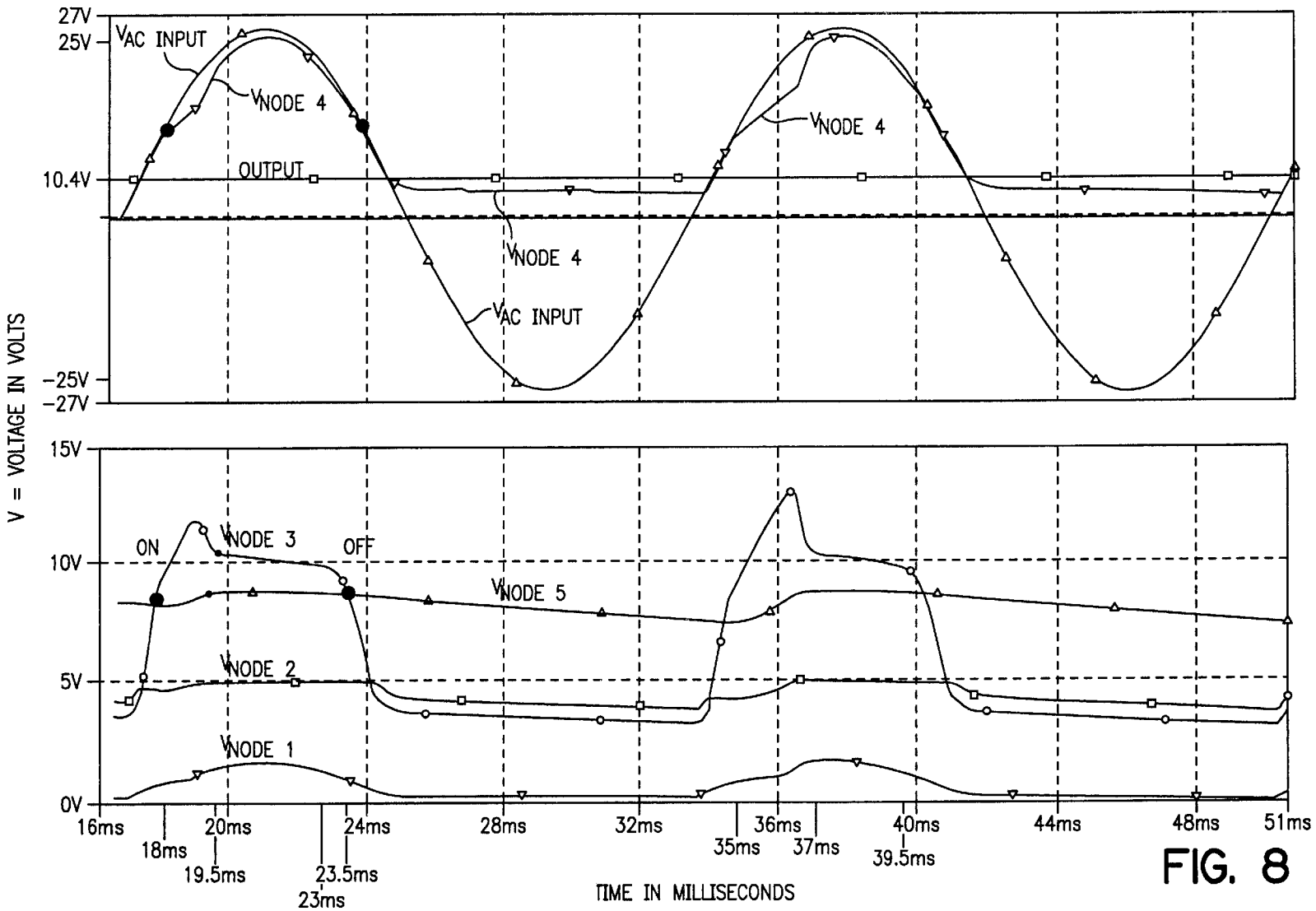
FIG. 8 is a graph of two AC cycles of a relatively low range of AC input voltage versus time, together with further graphs of voltage levels at different circuit nodes on the power supply circuit of FIG. 7.

During low voltage operation (e,g., 24 VAC) as shown in FIG. 8, the preferred embodiment depicted in FIG. 7 operates in the following manner. When the peak AC input voltage level remains low enough such that the voltage level at NODE 1 never exceeds the breakdown voltage of Zener diode 706C plus the forward biasing voltage of transistor 734, then transistor 734 remains off. Under this operating condition, the circuitry associated with comparator 706A can be ignored.

When the AC input voltage reaches a level such that the voltage at NODE 3 starts to exceed the voltage at NODE 5, then transistor 704A and 704B will become forward biased, thus turning on switch 704 and allowing a charging current to flow through transistor 704B. The charging current charges capacitor 708 through resistor 754 causing the voltage at NODE 5 to rise and supplies current to voltage regulator 710. The rise in voltage at NODE 5 can be seen between the 18 to 19.5 ms and 35 to 37 ms time periods. When the voltage at NODE 5 rises to a level such that voltage at NODE 2 exceeds the breakdown voltage of Zener diode 706C plus the forward biasing voltage of transistor 744, then transistor 744 will turn on and limit the voltage at NODE 3 and NODE 5. This can be seen as the leveling off of the two NODE voltages between the 19.5 to 23 ms and 37 to 39.5 ms time periods.

When the AC input voltage falls to a level such that the voltage at NODE 3 goes below the voltage of NODE 5 plus the forward biasing voltages of transistor 704A and transistor 704B, transistor 704A and transistor 704B will turn off and remove the charging current through resistor 754 to capacitor 708. When the charging current is removed, current is supplied by the discharging of capacitor 708, thus causing the voltage at NODE 5 to decrease slowly. This occurs at the 23.5 to 35 ms time period on the graph.

If the capacitance of capacitor 708 is such that the voltage at NODE 5 never falls below the minimum input voltage of the voltage regulator 710, then a constant output voltage is maintained across output load 720.

Figure 9:
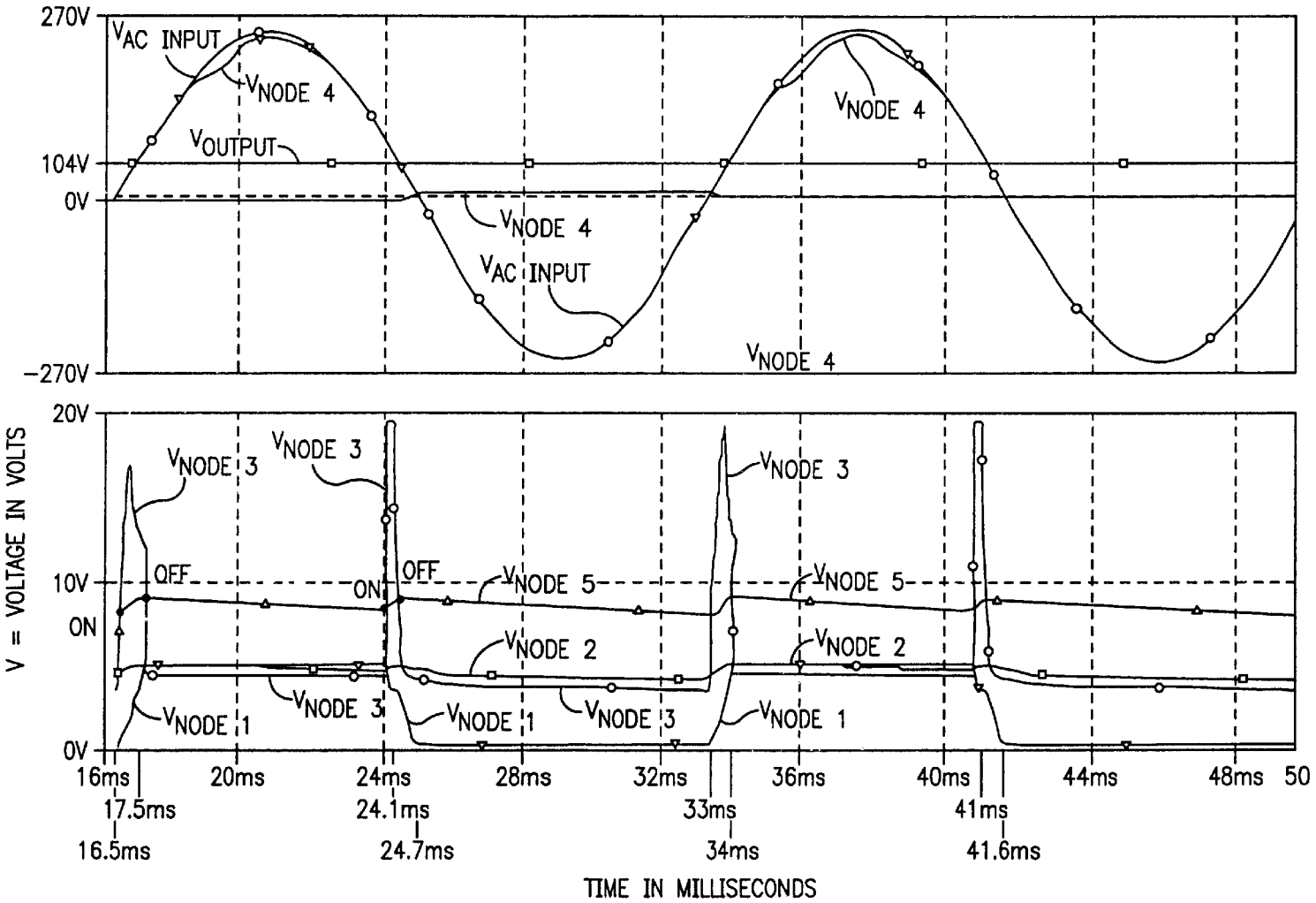
FIG. 9 is a graph of two cycles of a relatively high range of AC input voltage versus time, together with further graphs of voltage levels at different circuit nodes on the power supply circuit of FIG. 7.

During high voltage operation (e.g., 240 VAC) as shown in FIG. 9, the preferred embodiment depicted in FIG. 7 operates in the following manner. At higher input voltages, the operation of comparator 706A cannot be ignored. When the AC input voltage reaches a level such that the voltage at NODE 3 exceeds the voltage at NODE 5 plus the forward biasing voltages of transistors 704A and 704B, and the voltage at NODE 1 is below the breakdown voltage of Zener diode 706C plus the forward biasing voltage of transistor 734, then switch 704 will turn on and charge capacitor 708 through resistor 754 causing the voltage at NODE 5 to rise. If the voltage at NODE 5 rises to a level such that the voltage at NODE 2 exceeds the breakdown voltage of Zener diode 706C plus the forward biasing voltage of transistor 744, then transistor 744 will turn on and limit the voltage at NODE 3 and NODE 5. This rising and voltage limiting of NODE 5 can be seen between the 16.5 to 17.5 ms and 33 to 34 ms time periods on the high voltage input graph depicted in FIG. 9. When the input voltage reaches a level such that the voltage at NODE 1 exceeds the breakdown voltage of Zener diode 706C plus the forward biasing voltage of transistor 734, transistor 734 will turn on and pull the voltage at NODE 3 below that of NODE 5 plus the forward biasing voltage of transistors 704A and 704B, thereby turning off switch 704 and removing the charging current through resistor 754 to capacitor 708. When the charging current is removed, current is supplied by the discharging of capacitor 708, thus causing the voltage at NODE 5 to diminish slowly. The pulling down of the voltage at NODE 3 and the diminishing voltage level at NODE 5 can be seen between the 17.5 to 24 ms and 34 to 41 ms time periods.

When the AC input voltage falls to a level such that the voltage at NODE 1 falls below the breakdown voltage of Zener diode 706C plus the forward biasing voltage of transistor 734, the transistor 734 will turn off and allow the voltage at NODE 3 to rise above the voltage of NODE 5 plus the forward biasing voltages of transistors 704A and 704B, thereby turning on switch 704. The charging current through switch 704 charges up capacitor 708 through resistor 754 and ramps up the voltage at NODE 5. If the voltage at NODE 5 rises to a level such that the voltage at NODE 2 exceeds the breakdown voltage of Zener diode 706C plus the forward bias voltage of transistor 744, then transistor 744 will turn on and limit the voltage at NODE 3 and NODE 5. The turning off of transistor 734 and the rising of the voltage at NODE 3 can be seen at the 24.1 and 41 ms time periods. The ramping of the voltage at NODE 5 can be seen at the 24.1 to 24.7 ms and the 41 to 41.6 ms time periods. When the AC input falls to a level such that the voltage at NODE 3 is below the voltage at NODE 5 plus the forward biasing voltage of transistors 704A and 704B, then transistor 704A and transistor 704B become reverse biased (turning off switch 704) and the voltage at NODE 5 begins to diminish. The diminishing voltage level can be seen between the 24.1 to 33 ms time period.

If the capacitance of capacitor 708 is such that the voltage at NODE 5 never falls below the minimum input voltage of the regulator 710, then a constant output voltage is maintained. The Zener diode 706D is used to limit the maximum voltage at NODE 3 which prevents excessive charging current to the capacitor 708. This voltage limiting can be seen as the flat portion of the NODE 3 waveform at the 24.1 to 24.7 ms and 41 to 41.6 ms time period.

By avoiding the need for power dissipation, the circuit 70 produces load current at high efficiency. Further, the transistors 734, 744, 704A, and 704B, and the diodes 702A, 706C, 706D, avoid exposure to heat, which allows them to have stable clamping voltage set points, as well as stable turn off voltage set points. Thus, the invention provides a switching power supply circuit with reduced power dissipation, which increases operation stability and miniaturization suitability, while increasing efficiency of the circuit to generate load current. Further, the power circuit operates within wide ranges of AC input voltages.

The operation of the preferred circuit depicted in FIG. 7 as illustrated in FIGS. 8 and 9 was achieved using components of the following ratings:

Resistor 702B=30 Ohms

Resistor 730=1 Mega-Ohms

Resistor 732=75 kilo-Ohms

Resistor 740=54 kilo-Ohms

Resistor 742=68 kilo-Ohms

Resistor 750=100 kilo-Ohms

Resistor 752=10 kilo-Ohms

Resistor 754=20 Ohms

Capacitor 708 is 140 $\mu$f

Breakdown voltage of Zener diode 706C=4.3V

Breakdown voltage of Zener diode 706D=18V

Figure 10:
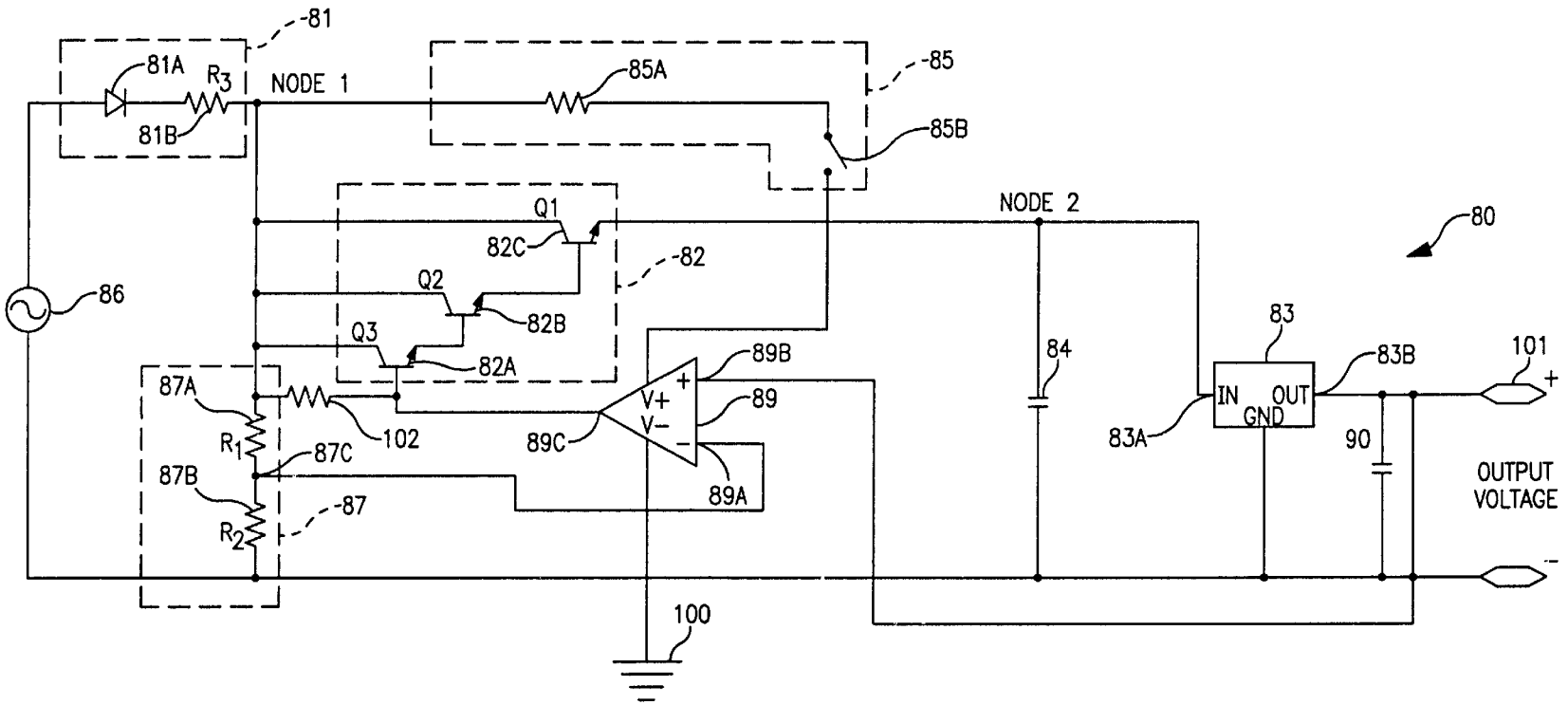
FIG. 10 is a circuit diagram of a power supply circuit in accordance with an alternative embodiment of the present invention.

FIG. 10 depicts a circuit diagram 80 of an alternative embodiment of the power circuit of the present invention. The circuit 80 comprise rectifier circuit 81, switch 82, comparator 89, voltage divider 87, capacitor 84, and a voltage regulator 83. In addition, the circuit contains a startup circuit 85 and an output capacitor 90.

In the alternative embodiment, an AC source 86 is coupled between the rectifier circuit 81 and a ground terminal 100. Rectifier circuit 81 comprises resistor 81B and diode 81A which is a half-wave rectifier. Due to diode 81 A, the rectifier circuit 81 allows only positive AC voltage to flow to NODE 1, thereby creating a fluctuating DC voltage at NODE 1.

Voltage divider 87 is coupled between NODE 1 and ground terminal 100. Voltage divider 87 comprises two resistors 87A and 87B. Voltage divider 87 defines an output voltage at voltage tap 87C. The voltage at voltage tap 87C is a fraction of the voltage on NODE 1 and is determined by the ratio of [resistor 87B/(resistor 87A+resistor 87B)].

Voltage regulator 83 is coupled between switch 82 and capacitor 84, and output terminal 101. The voltage regulator 83 provides a substantially constant voltage at output terminal 101 if the voltage level at the input 83A remains within a predefined range determined by the operating characteristics of the regulator 83.

Comparator 89 has an inverting input 89A coupled to voltage tap 87C, a non-inverting input 89B coupled to the output 83B of voltage regulator 83, and an output 89C coupled to switch 82. The comparator 89 has an open collector arrangement at its output 89C. It compares a reference voltage, which is the output 83B of the voltage regulator 83, with the voltage at voltage tap 87C. When the voltage level at voltage tap 87C is above the output voltage level at voltage regulator 83B, the comparator 89 will turn on its output transistor and pull the voltage level at its output 89C to ground, causing the emitter to base junctions of transistors 82A, 82B, and 82C to be reverse biased, thereby turning off the transistors and uncoupling NODE 1 from the power supply circuit 80.

When the voltage on NODE 1 is such that the voltage at voltage tap 87C is lower than the output voltage at voltage regulator 83, then the output transistor of comparator 89 is in the off state. Under this condition, capacitor 84 will charge up with current approximately equal to:

$$I_{charge}=[\beta_{Q1}\beta_{Q2}\beta_{Q3}/\text{resistor } \mathbf{102}][(V_{NODE1}-V_{NODE2})-(V_{beQ1}+V_{beQ2}+V_{beQ3})].$$

Transistors Q2 and Q3 serve to reduce the voltage drop across resistor 102 during the charge cycle. One or possibly both transistors may not be needed if higher charge currents are not required.

During normal operation, the power supply circuit 80 has three modes of operation. The first mode is the charge mode when the voltage on NODE 1 is greater than the voltage across capacitor 84 and the voltage at voltage tap 87C is less than the output voltage at voltage regulator output 83B. This results in comparator 89 being in the off state, thereby allowing switch 82 to turn on. Under this condition, capacitor 84 will charge up with the current $I_{charge}$. When the voltage on NODE 1 rises such that the voltage at voltage tap 87C is higher than the output voltage at voltage regulator output 83B, then comparator 89 turns on, pulling the base of transistor 82A to ground, thereby turning transistors 82A, 82B, and 82C off. This results in the circuit entering a second mode (i.e., discharge mode). In the discharge mode, capacitor 84 supplies the current needed by regulator 83 at voltage regulator input 83A. Capacitor 84 must be large enough to supply the current needed by regulator 83 without dropping below the regulator's required minimum input voltage. The third mode of operation is when the voltage on NODE 1 is less than the voltage across capacitor 84. Under this condition the output transistor of comparator 89 is in the off state, however no charge current exists because the emitter to base junctions of transistors 82A, 82B, and 82C are reversed biased due to NODE 1 being at a lower voltage than the voltage across capacitor 84. Therefore, the capacitor 84 must again supply the current and voltage needed by regulator 82.

The charging mode of operation preferably is short compared with the total time of the AC input voltage cycle. In such an embodiment, transistors 82A, 82B, and 82C are turned on only for a small percentage of the cycle time and thus have low-average power dissipation. Resistor R3 may be used to extend the charge time. The charge current $I_{charge}$ will increase the voltage drop across resistor R3, reducing the voltage at NODE 1 for as long as the current $I_{charge}$ is flowing.

Capacitor 90 at the output of the voltage regulator 82 serves to average out the peak current draws of the load applied to the voltage regulator. The size of the capacitor 90 is chosen based on the peak current levels and durations at the load.

Start-up path 85 may be used to initially charge capacitor 84 prior to normal operation. During start-up, switch 85B is closed and the voltage at NODE 1 supplies a positive voltage to capacitor 84 through diode 81A, resistor 99B, and resistor 85A. When the voltage on capacitor 84 has reached a level high enough to operate voltage regulator 83 and comparator 89, switch 85B opens and the start-up path is removed from the circuit 80. Alternatively, the start-up path may remain in the circuit during normal operation.

The present invention eliminates the need for components of the power supply switching circuit to dissipate heat when the AC input voltage level is high since the AC input voltage is uncoupled from the circuit during periods of high AC input voltage. Therefore, more compact, low power circuit components can be used. The circuit can be implemented with discrete components or as an integrated circuit.

Having thus described a few particular embodiments of the invention, various alterations, modifications, and improvements will readily occur to those skilled in the art. Such alterations, modifications and improvements as are made obvious by this disclosure are intended to be part of this description though not expressly stated herein, and are intended to be within the spirit and scope of the invention. Accordingly, the foregoing description is by way of example only, and not limiting. The invention is limited only as defined in the following claims and equivalents thereto.

What is claimed is:

1. A DC power supply circuit comprising:

a capacitive element; and switching circuitry for coupling AC power impressed on an AC input terminal to a DC output terminal and to said capacitive element when said AC power is within a preselected AC voltage range, and for uncoupling said AC power from said DC output terminal and from said capacitive element when said AC power is outside of said preselected AC voltage range, wherein said preselected AC voltage range excludes a portion of positive AC voltage;

wherein said capacitive element is configured to discharge and supply power to said DC output terminal while said AC input is outside of said preselected AC voltage range.

2. The DC power supply circuit of claim 1, wherein said portion of positive AC voltage includes peak AC voltage.

3. The DC power supply circuit of claim 1, wherein said switching circuitry comprises at least:

a rectifier having an input for coupling to said AC power and an output, said rectifier passing a rectified voltage at the output;

a switch having an input coupled to the output of said rectifier, an output coupled to said capacitive element and to said DC output terminal, and a control terminal, said switch at least turning on and off in response to a signal at said control terminal; when said switch is on, said switch couples said AC power to said DC output terminal and to said capacitive element; and when said switch is off, said switch uncouples said AC power from said DC output terminal and from said capacitive element;

a comparator having a first input coupled to a first reference voltage which is representative of said rectified voltage, a second input coupled to a second reference voltage which is representative of the voltage level at said DC output terminal, and an output coupled to the control terminal of said switch, said comparator providing a signal to said control terminal based on the voltage level of said first reference voltage and the voltage level of said second reference voltage.

4. The DC power supply circuit of claim 3, wherein said capacitive element is a capacitor, said capacitor capable of storing a charge sufficient to maintain a preselected output from said DC power supply circuit during periods when said switch is off.

5. The DC power supply circuit of claim 4, further comprising a voltage regulator having an input coupled to the output of said switch and to said capacitor, and an output coupled to said DC output terminal, said voltage regulator adapted to regulate the voltage level at said DC output terminal.

6. The DC power supply circuit of claim 5, further comprising a load capacitor coupled to the output of said voltage regulator for averaging the peak current draws of a load.

7. The DC power supply circuit of claim 5, wherein said comparator compares said first reference voltage to a first predefined voltage and compares said second reference voltage to a second predefined voltage, when said first reference voltage exceeds said first predefined voltage, said comparator turns said switch off, thereby uncoupling said AC input from said output, when said second reference voltage exceeds said second predefined voltage, said comparator regulates said switch, thereby regulating current flow from said AC input to said output.

8. The DC power supply circuit of claim 7, wherein said AC power charges said capacitor and provides power to said comparator and said regulator when said switch is on, and said capacitor provides power to said comparator and said regulator when said switch is off.

9. The DC power supply circuit of claim 8, wherein said first predefined voltage is equal to said second predefined voltage.

10. The DC power supply circuit of claim 9, wherein said first reference voltage is provided at a first tap of a first voltage divider comprising two resistors coupled in series between the input of said switch and a ground terminal, and said second reference voltage is provided at a second tap of a second voltage divider comprising two resistors coupled in series between the output of said switch and said ground terminal.

11. The DC power supply circuit of claim 8, wherein said switch comprises at least one transistor.

12. The DC power supply circuit of claim 11, wherein said switch comprises a chain of transistors.

13. The DC power supply circuit of claim 5, wherein said comparator compares said first reference voltage to said second reference voltage, when said first reference voltage exceeds said second reference voltage, said comparator turns said switch off, thereby uncoupling said AC input from said output.

14. The DC power supply circuit of claim 13, wherein said switch is off when the voltage level at the control terminal of said switch signal is less than the voltage level at the output of said switch, said switch is off when said first reference voltage exceeds said second reference voltage, and said switch is on when the voltage level at the control of said switch exceeds the voltage at the output of said switch and said second reference voltage exceeds said first reference voltage.

15. A power supply circuit for producing a DC output from an AC input comprising:

a capacitive element;

a rectifier having an input for coupling to said AC input and an output, said rectifier passing rectified voltage at the output;

a first comparator coupled to the output of said rectifier, said first comparator providing a first reference voltage and comparing said first reference voltage to a predefined voltage level;

a switch having an input coupled to the output of said rectifier, an output coupled to said capacitive element and to a DC output terminal, and a control terminal coupled to said first comparator, said switch coupling said AC input to said DC output terminal and to said capacitive element when said switch is on and uncoupling said AC input to said DC output terminal and its said capacitive element when said switch is off; and a second comparator coupled to said DC output terminal, said second comparator providing a second reference voltage and comparing said second reference voltage to said predefined voltage level;

wherein said switch is off when the voltage level on the control terminal of said switch is below the voltage level of the output of said switch, said switch is off when said first reference voltage exceeds said predefined voltage, and said switch is on when the voltage level on the output of said switch is below the voltage level on the control terminal of said switch and said predefined voltage exceeds said first reference voltage; and wherein when said switch is on, said second comparator regulates current flow between said AC input and said DC output terminal.

16. The power supply circuit of claim 15, further comprising:

a voltage regulator having an input and an output, said input being coupled to said capacitive element and to said switch, and said output being coupled to said DC output terminal, said voltage regulator capable of producing a substantially constant DC voltage at said DC output terminal if the voltage level at the input of said voltage regulator is maintained within a specified voltage range.

17. The power supply circuit of claim 15, wherein said first comparator comprises:

a first voltage divider coupled between the input of said switch and a ground terminal, said first voltage divider having a tap for providing said first reference voltage;

a first transistor having a base coupled to the tap of said first voltage divider, a collector coupled to the control terminal of said switch, and an emitter; and a Zener diode coupled between the emitter of said first transistor and said ground terminal, the Zener breakdown voltage of said Zener diode plus the forward biasing voltage of said first transistor defining said predefined voltage;

wherein said first transistor conducts, thereby turning said switch off, when said first reference voltage exceeds the Zener breakdown voltage of said Zener diode plus the forward biasing voltage of said first transistor, and said second comparator comprises:

a second voltage divider coupled between the output of said switch and a ground terminal, said second voltage divider having a tap for providing said second reference voltage; and a second transistor having a base coupled to the tap of said second voltage divider, a collector coupled to the control terminal of said switch, and an emitter coupled to said Zener diode;

wherein said second transistor conducts, thereby regulating said switch, when said second reference voltage exceeds the Zener breakdown voltage of said Zener diode plus the forward biasing voltage of said second transistor.

18. The power supply circuit of claim 17, wherein said switch comprises a third transistor.

19. The power supply circuit of claim 17, wherein said switch comprises a transistor chain of two or more transistors.

20. A method for generating a DC output at an output terminal from an AC input at an input terminal comprising the steps of:

coupling the AC input to the DC output terminal and to a capacitor when said AC input is within a preselected AC voltage range thereby providing power to the DC output terminal while charging the capacitor, wherein said preselected AC voltage range excludes a portion of positive AC voltage, and uncoupling the AC input from the DC output terminal and the capacitor when the AC input is outside of the preselected voltage range, thereby relying on the capacitor to provide power to the DC output terminal.

21. The DC power supply circuit of claim 1, wherein the DC power supply circuit does not have a transformer.

22. The power supply circuit of claim 15, wherein the power supply circuit does not have a transformer.

23. The method of claim 20, wherein the AC input does not pass through a transformer.

* * * * *